United States Patent [19]

Lund

[11] Patent Number: 4,570,694

[45] Date of Patent: Feb. 18, 1986

[54] MOLD-BLOWING APPARATUS

[76] Inventor: Robert S. Lund, 458 Elm St., Elmhurst, Ill. 60126

[21] Appl. No.: 599,728

[22] Filed: Apr. 12, 1984

Related U.S. Application Data

[63] Continuation-in-part of Ser. No. 342,071, Jan. 25, 1982, Pat. No. 4,460,032.

[51] Int. Cl.[4] ..... B22C 15/22

[52] U.S. Cl. ..... 164/158; 164/200; 164/201; 164/202

[58] Field of Search ..... 164/38, 158, 187, 200, 164/201, 202, 207, 195

[56] References Cited

U.S. PATENT DOCUMENTS 2,611,938 9/1952 Hansberg ..... 164/201
3,590,906 7/1971 Bayliss et al. ..... 164/200
3,999,592 12/1976 Kopp et al. ..... 164/200
4,135,569 7/1977 Drobnik et al. ..... 164/200

*Primary Examiner*—Nicholas P. Godici
*Assistant Examiner*—Richard K. Seidel

[57] ABSTRACT

As in the parent application, a freshly mixed quick-setting sand mix is blown from a blow box into a mold while a plunger moves through the blow box to chase all of the fluidized sand into the mold. Here, the blow box sand cavity is formed by a tube extending downward but leaving an annular gap above the blow plate. The fluidizing air tends to move bottom sand directly through the center exit in the blow plate. With quick setting sand, any residue is blown into a purge pan while the plunger is advanced. With sand that is not quick setting, and without the plunger, nearly all residual sand settles and tends to be the first blown into the mold during the succeeding blow.

19 Claims, 12 Drawing Figures

CONTROL SYSTEM
29B
29C
32C
30
CS
83
32B
31
28
27
78
57
22
58
24A
24B
26
34
36
51
V
RV
53
47
50
48a
49
79
55
56
52
54
42
44
46
41
21
19
43
45
33
38
37
39
35
16
48
11
11A
12
69
17
66
76
81
18
13
14
71
68

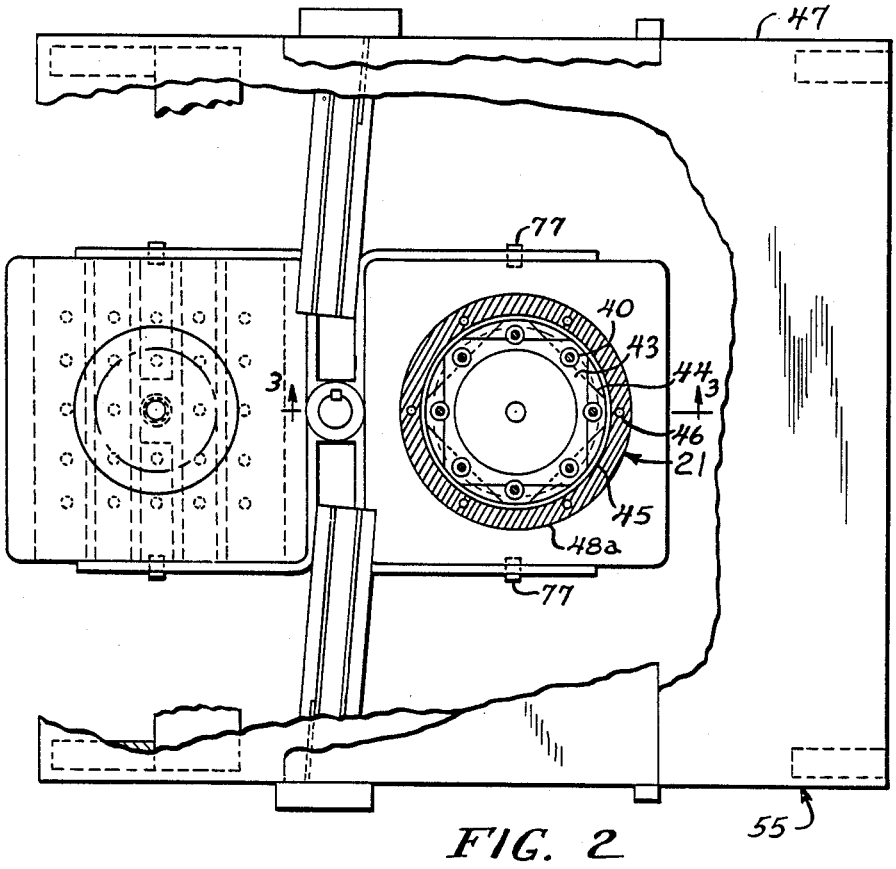
FIG. 2
FIG. 3
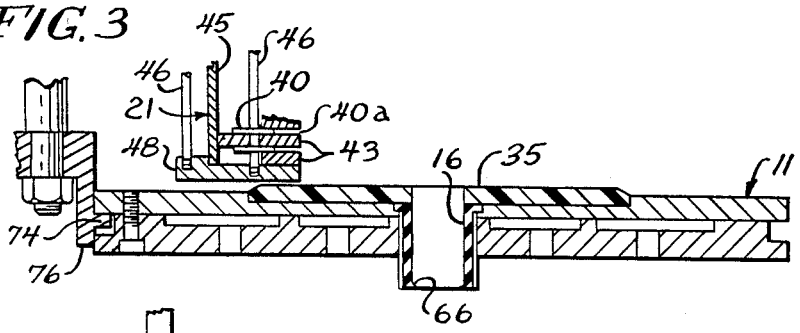
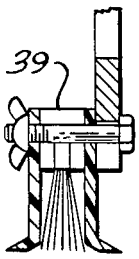
FIG. 4

CS
120
92
123
117
122
121
119
91
124
125
106
89
88
84
87
102
95
94
107
105
93
113
111
112
108
109

92
91
102
105
107
111
93

MOLD-BLOWING APPARATUS

INTRODUCTION

This application is a continuation-in-part of the present applicant's parent application Ser. No. 342,071, filed Jan. 25, 1982, issued July 17, 1984 as U.S. Pat. No. 4,460,032.

This application is a double-function application. As a C-I-P application, it serves as a divisional application, although the divisional claims are here held withdrawn from prosecution after a requirement to restrict.

In its other function, this application relates to a very important separate invention that both enhances the old and is useful without it.

In its continuation aspect, the application relates to the important concept of using a plunger moving through the blow box while air fluidizes the sand in the blow box and blows it into the mold. This is important because at the end of the stroke of the plunger, it leaves almost no room within the blow box for retaining swirling sand, and hence virtually all of the sand is blown into the mold. This is especially important with quick-setting sand which would set-up in the blow box if retained.

In its additional-invention aspect, the application relates to an important new concept that is valuable without the above, but enhances the above if the above is also present. This is the concept of admitting the fluidizing air to the blow box only (or at least mainly) through a peripheral slot at the bottom of the blow box. With the plunger invention, the entire air flow is at a location that remains fully effective and efficient as the plunger advances. When the plunger is as low as the top of the slot, the entire air stream has no place to go except directly through the exit into the mold (or, after the mold is lowered, into a purge receptacle moved into place). If the plunger is not used, as when non-quick-set or conventional sand mix is used, there are still important advantages to be discussed.

The bottom-blow claims are chosen for prosecution here because of their wider importance. With and without the plunger, the fluidizing air is unusually efficient, blowing sand directly to the exit. With prior blow boxes, blowing air through apertures throughout the cavity wall, much more compressed air was required, because it was used less efficiently.

The blow box with the air entering only at the bottom slot is also exceptionally inexpensive to manufacture. The cavity is formed mainly by a smooth-walled tube suspended slightly above the bottom of the blow box to form the slot, and the plunger is easily made to wipe the tubular wall clean.

With apertures throughout the chamber wall the apertures had to be quite small so that the sand would be confined. With the slot at the bottom, the slot width can be considerably larger than the sand size. When sand is dumped into the cavity, it spreads out through the slot only the slight amount permitted by its angle of repose. Being already at the bottom, it has no place to go. At the end of the blow (or before) it is all blown out of the blow box, leaving the slot clean.

Another important advantage of the bottom slot is that if there should be a slight residue of sand after one blow is completed, this residue will be the first blown from the blow box on the next blow. This is because the residue naturally settles to the bottom where it is in the prime position for being blown into the mold by the air entering through the bottom slot. With ordinary sand, that is not quick-setting, purging tends to be unnecessary, because when the residue is blown out first with each blow, there is no danger that (with ordinary sand) any of it will stay through successive blows until it deteriorates.

The importance of purging when quick-set sand is used is quite another matter. As the provision of the purging features recognizes, there is likely not to be achieved without it the total cleansing of all sand from the blow box before the sand can set. The undesirablity of any sand residue of the quick setting character that would set-up between blows has been brought out above. When the mold is removed, its resistance to the flow of air ceases, and the subsequent purging blast has the maximum chance of blowing out any sand tending to cling to the blow box surfaces. It is apparent that with the plunger down during a part of this purging blast, a maximum speed of air will exert a cleaning effect along the bottom of the plunger and the top of the blow plate.

Although the first figures of the drawing are from the prior application, the machine illustrated by them, though quite satisfactory is not now preferred. It used pairs of elements, shuttling each member of the pair between a position for being used in the blow and a fill or cleaning position out of the way during blowing It is now preferred to use a very high speed mixer, which is one of the features of the present application, and a single shuttling charging tube which spends most of its time at the blow position, but shuttles quickly to receive a load dumped from the rapid mixer and moves to dump it into the blow box, the plunger then moving through it and the blow box. This is illustrated, diagrammatically, in the later figures of the drawings.

DESIGNATION OF FIGURES

FIG. 2 is a view, somewhat diagrammatic, looking downwardly approxmately from the line 2—2 of FIG. 1.

FIG. 3 is a fragmentary vertical sectional view through a blow plate, and through a fragment of the blow box of FIG. 1.

FIG. 4 is a detail sectional view vertically through a brush and anchor unit.

Because of their schematic nature, the views are not always consistent. The foregoing views are taken from the prior application.

Figure 5:
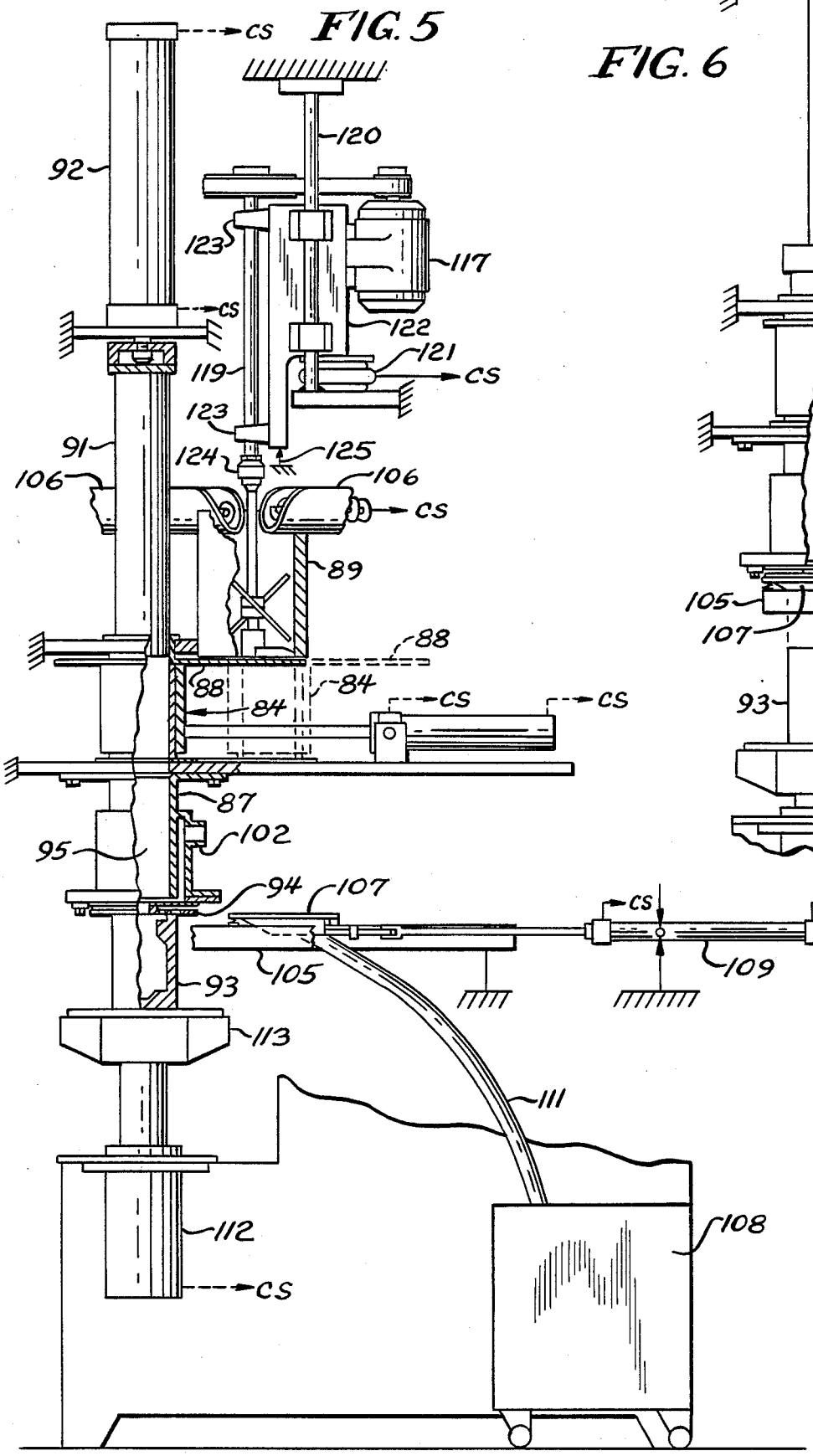

FIG. 5 is a side view, somewhat in vertical section, diagrammatically representing the bottom-blow form of the invention now greatly preferred.

Figure 6:
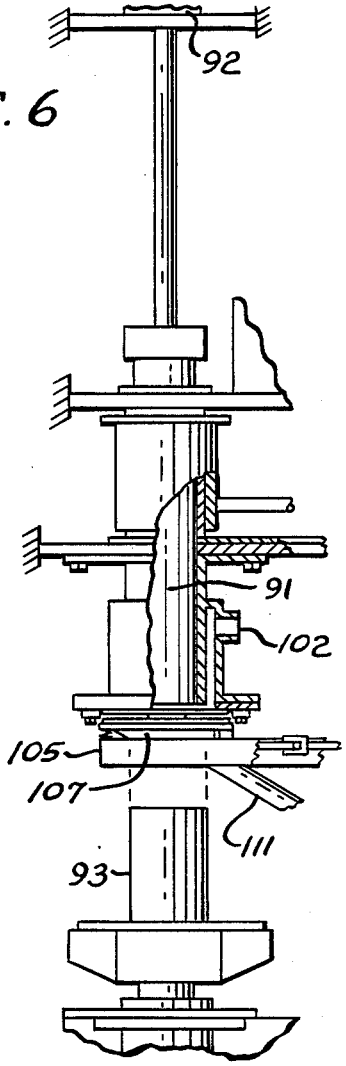

FIG. 6 shows the plunger moved through the blow box, being otherwise similar to parts of FIG. 5.

Figure 7:
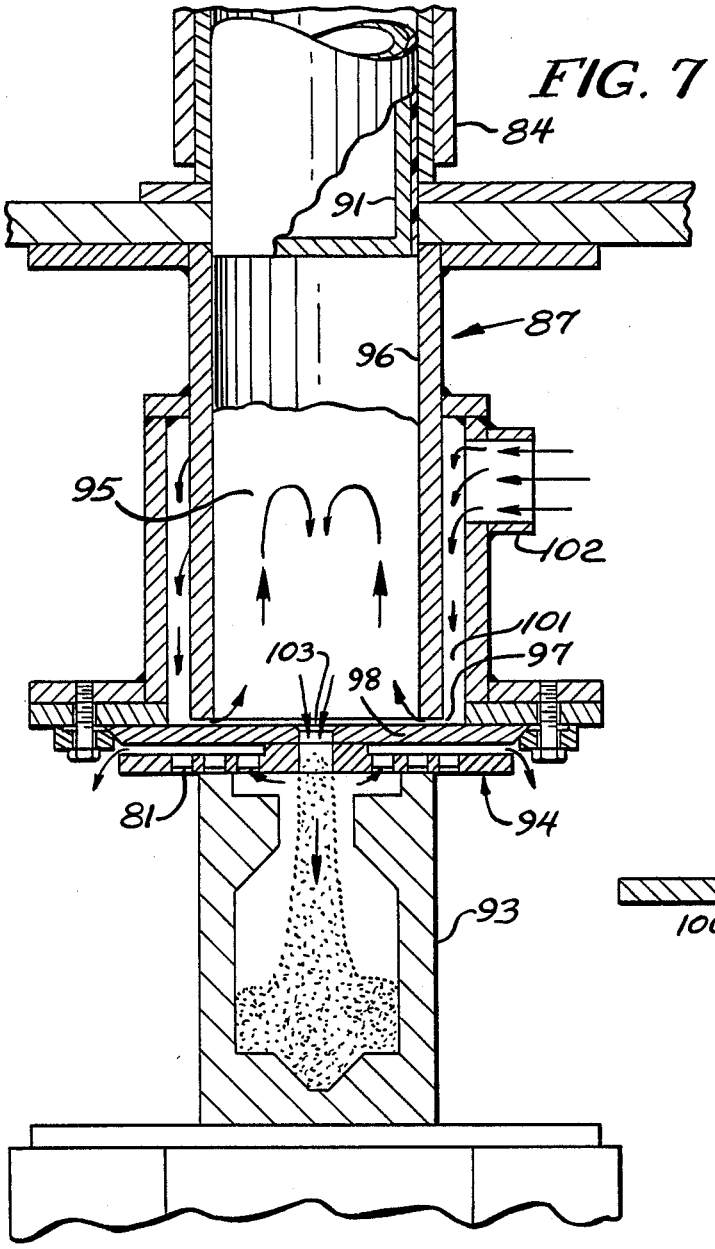

FIG. 7 is a larger-scale vertical sectional view of the blow box.

Figure 8:
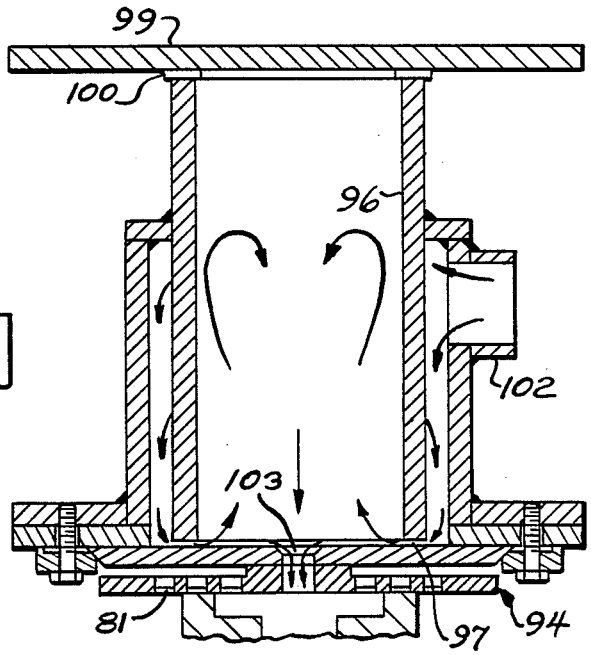

FIG. 8 is similar, but modified for one use of conventional sand mix.

Figure 9:
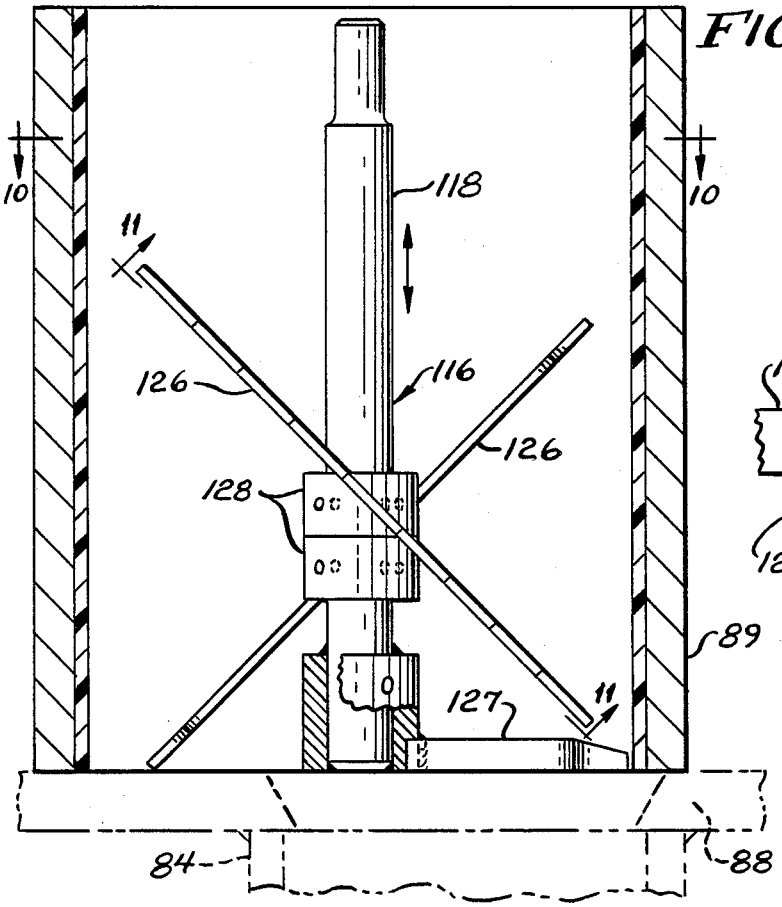
Figure 12:
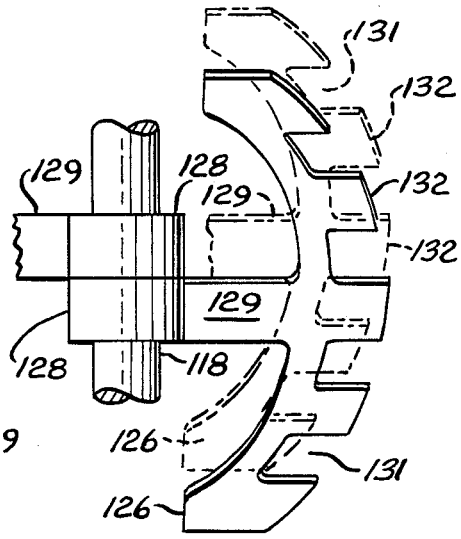

FIGS. 9 to 12 are views of the high-speed mixer of the present invention; FIG. 9 a vertical section, FIG. 10 looking down from the line 10—10 of FIG. 9, FIG. 11 a full-face view of a mixing blade, and FIG. 12 a fragmentary side view showing both blades on the shaft, the broken lines showing a phantom position of the upper blade.

BACKGROUND DESCRIPTION

Foundry blowing machines for blowing a sand mix into molds have commonly included some sort of blow plate 11 for engaging a cope 12 which mates with a drag 13 to form a mold. It is common for the drag 13 to be clamped on a clamp table 14 which lowers the drag 13 after the sand mix filling the mold box 12,13 has set, thereby drawing the molded piece down from the cope to a position from which it may be removed manually or automatically.

It is common for the blow plate 11 to have a central blow tube 16 through which the sand mix is blown into the mold box, and to have vents 17 through which air can escape from the mold box.

Although some other aspects of the invention are also common to some degree, they are interrelated to the novelty described below, and are described therewith.

GIST OF PLUNGER INVENTION

In essential terms, the gist of the invention is that the exact quantity of freshly mixed sand mix needed for filling the cavity 18 of mold box 12,13 is dumped into the central cavity 19 of blow box 21, and a plunger 22 which neatly fits the cavity 19 is moved down through it while air is simultaneously being blown into cavity 19 to fluidize the sand and blow it into the cavity 18 to fill this cavity; plunger 22 stripping all sand from the blow box 21. If there is any residue of unused sand mix, it is cleaned away before the next operation.

Figure 1:
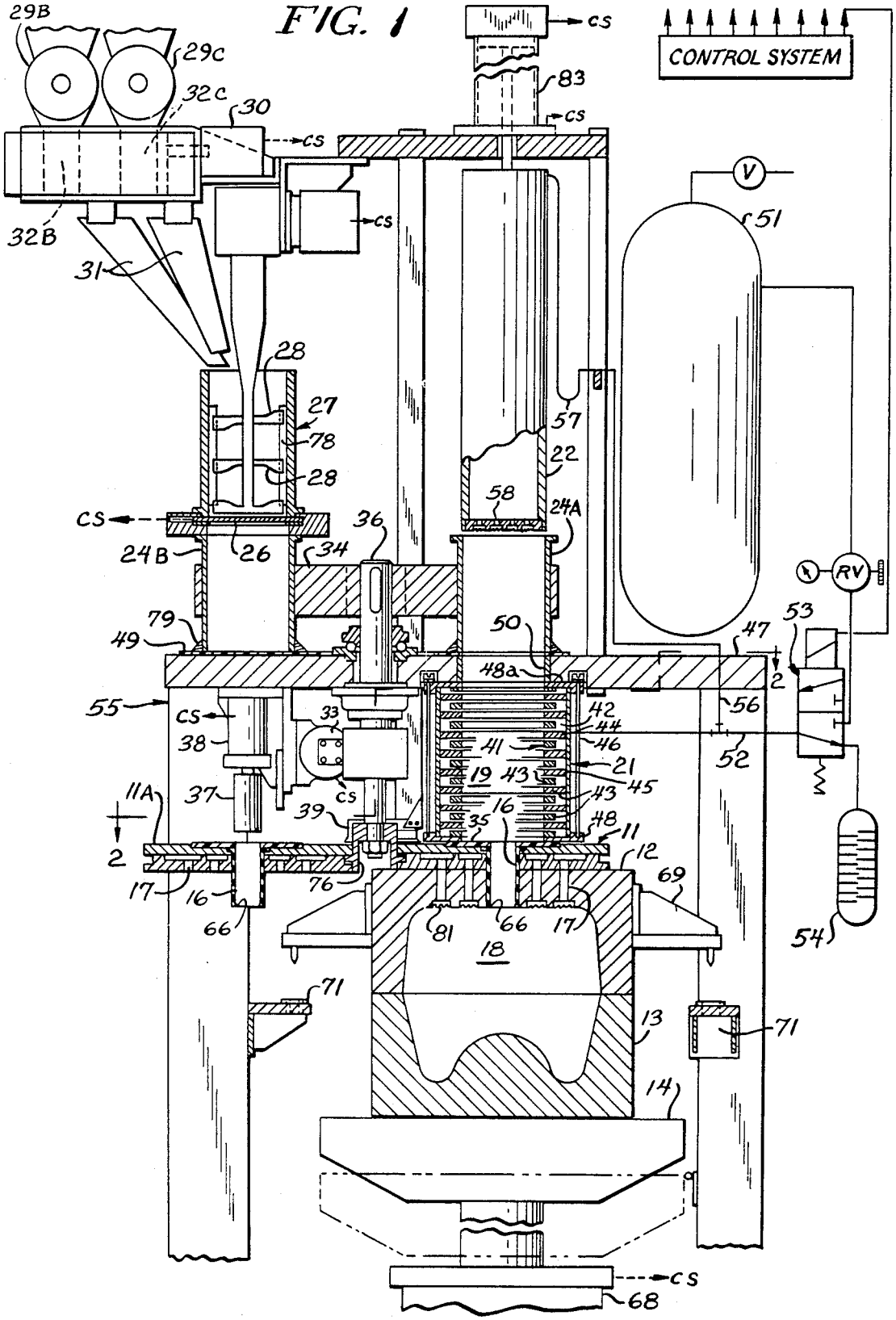
FIG. 1 is a view largely diagrammatic, but partly in vertical section illustrating the principle of the invention, in the twin-tube form that was preferred at the time of filing the prior application.

Being only slightly more specific with respect to FIG. 1, the dumping is to two interchanging magazine tubes 24A and 24B. While either is in the position over blow box 21 for dumping (as tube 24A is shown) the other is in a position for receiving its charge, as tube 24B is shown. Its charge is received by opening gate 26 to dump into the magazine tube 24B (or A) the freshly mixed contents of mixer 27 having rotary mixing paddles 28. When the charge has been dumped into the magazine tube, gate 26 is closed. Later the ingredients for another change are fed to the rapid mixer 27. These ingredients comprise two different sand mixes, each stable until mixed with the other. These are mixed separately, as by mixers 29B and 29C. They are simultaneously discharged, each to its own funnel 31 by measuring dispensers 32B and 32C which may be simultaneously actuated by actuator 30. The letters "B" and "C" are chosen because in one the end sand may be mixed with a binder or resin and in the other with a catalyst, as in epoxy cements.

When the cavity 18 has been filled, plunger 22 is withdrawn to its FIG. 1 position and and the two magazine tubes 24A and B are interchanged as to their positions by oscillation motor 33 which swings the tube holder 34 through 180°. This dumps a new batch of sand mix into blow box 21, and places an empty magazine tube in place for receiving a new charge.

With quick setting sand mixes, it is important that no residue be left in the blow tube 16 or on the face of its "Teflon" pad 35. In order that these may be cleaned after each use, two interchanging blow plates 11 and 11A are provided. These are carried by the same shaft 36 that carries tube holder 34, so as to be oscillated 180° with the two magazine tubes 24A and B. While sand mix is being blown through one blow tube 16, the other is being cleaned by a plunger 37 projected through it by an actuator 38. As each blow plate 11 passes from the blow position to the cleaning position, it passes under one of the two brush-scraper units 39 to be cleaned by it on its upper surface, especially the surface of pad 35.

BLOW BOX AS PREVIOUSLY PREFERRED

The blow box 21 is so constructed that it can be wiped clean during each use by the plunger 22. Its apertured cylinder 41 which separates its air chamber 42 from the contral cavity 19 snuggly fits the plunger 22 so as to be wiped clean by it. In the form at one time preferred it comprised a stack of spaced plates 43 separated by very thin washers 40 to provide thin slots **40*a* between the plates. The plates all have the same internal diameter and are held accurately stacked to provide a smooth inner surface that can be wiped clean by the plunger 22. Of course the slits between the plates make this surface non-continuous, but the continuing blow of air through these slits ensures that sand wiped toward a slit by plunger 22 will be blown inwardly, toward the center of cavity 19. The plates 43 can be held accurately stacked by projecting tabs 44. These may have a press fit with the inner surface of shell 45, as seen in FIGS. 2, 3. Plates 43 may be held from angular shifting by tie rods 46, if some of these extend through these plates, as shown. The tie rods may extend down from top plate 48*a* to thread into bottom plate 48 of blow box 21**.

FURTHER DETAILS AND MODIFICATIONS—EARY FORM

The preliminary mixer-feeders 29B,C may be batch fed or continuously fed, in either case supplying the proper proportions of sand and binder or catalyst, respectively. Unless these additives are liquids, easily mixed with the sand, foundry mullers may be used first. With any such advance mixing, the charging devices 32B, C may merely measure out by weight or volume. However, mixing feeders 29B and 29C have been indicated, being preferred for the liquid additives most likely to be used for quick setting sand mixes. The broken line arrow "CS" merely indicates control by the control system indicated diagrammatically. This is also true of other "CS" arrows.

It would be possible to omit one of the two magazine tubes 24A,B, and one of the blow tubes 16. That could reduce the overall speed of production, however. In that event the timing of the discharges from measuring dispensers 32B,C would be delayed until there would barely be time for thorough mixing by the rapid mixer 27 before the single magazine tube 24A or B reached its receiving position. The two positions would not have to be separated by 180° however. Although the 180° movements of holder 34 and shaft 36 could be in the same direction, an oscillatory 180° actuator is readily available and of known accuracy and dependability.

The two magazine tubes 24A and B preferably slide along a smooth "Teflon" (or other non-stick, low friction and long wearing) surface 49. In the form illustrated, this is an annular surface, continuous except for its aperture over the blow box 21. This aperture, and the I.D. of sleeve 50 in deck plate 47 of the main frame 55 should be accurately of the same diameter as cavity 19 so as to be wiped clean by plunger 22, as are also the tubes 24A and B.

The control of compressed air to blow box 21 may be conventional. A tank of air supplied by a compressor, not shown, is indicated at 51. A line 52 to the blow box 21 (jacket space 42) is alternately connected by solenoid valve 53 to tank 51 or to discharge through muffler 54. According to the present invention, a branch line 56 leads from line 52 through flexible hose 57 to the inside of plunger 22, which is closed except for ports 58 in its leading end. These ports 58 maintain a supply of blowing air when the plunger has cut off the air flow through the slits in slit cylinder 41.

The entrance from cavity 18 to each vent passage 17 is provided with the conventional fine screen to block the escape of sand while permitting the escape of air. If these are pressed into recesses in the top wall of cope 12, as shown, they may need to be brushed clean, by a hand brush, or otherwise cleaned, after every few blows. If the cope 12 has an open top, with the screens in the bottom piece of blow plate 11 (or 11A) brushes similar to brushes 39 may be positioned to brush the screens clean during each 180° swing.

Although with the ideal use of this invention, the measuring dispensers 42B and C would measure out the precise amount of sand mix required to fill cavity 18 with no excess, it is probable that in actual practice a small excess will be provided to be sure to have enough. Because the lowered plunger 22 fills the space in cavity 19, the expected slight excess will substantially all be in blow tube 16, and will settle at the bottom of this tube upon the sudden cessation of the air blow at the end of the blow. It will usually be desirable to break this off of the core, and this may be accomplished by providing an internal lip 66 at the bottom of blow tube 16.

When the control system actuates elevator cylinder 68, the cope 12 is initially free to move downward, and tube 16, with its lip 66 breaks off the extra sand within the tube 16. When the cope 12 has been sufficiently lowered, the 180° swing will carry tube 16 with this broken off plug within it to the cleaning position represented by 11A in FIG. 1, and plunger 37 will eject the plug and any other residue of sand in tube 26. After that sufficient lowering of cope 12, its clamp ring 69 will come to rest on stops 71, and further downward movement of drag 13 by elevator cylinder 68 will draw the core or other molded piece from the cope 12. According to common practice, this draw should be at slow speed, although the cylinder 68 is then actuated at full speed to lower the drag 13 to the bottom position for unloading or stripping. The initial downward movement, before the draw starts, can be fast or slow. Because this initial lowering can take place while the piece's binder is setting, slow speed will probably be preferred. After unloading, the upward movement of elevating cylinder 68 can be at high speed, except that the cope must not be raised from stops 71 until the 180° swing has been completed so that the blow plate that was cleaned during the last blow is in place to receive cope 12. A slight amount of lost motion is provided in the mounting of the blow plates 11 and 11A. Each swings freely below blow box bottom plate 48 and then is raised up into sealing engagement with it by the rising cope 12. In the illustrated form this is accomplished by having the blow plate, e.g. 11, rest on an inward flange 74 on a U-frame 76 carried by shaft 36. Carrier or lost motion frame 76 should snugly position blow plate 11 with a sliding fit to let it be raised. Retainer screws 77 extend snugly into vertical slots in the edges of blow plates 11 to hold the blow plates in the U-frames with ready removability. If arcuate frames were used instead of U-frames, such pins would also prevent the blow plates from angular movement.

Plunger 22 preferably has a durable low-friction coating such as polyurethane.

A blow box 21 has been found to be satisfactory with its plates 43 ground flat and parallel with a thickness of 0.250 inch, and its washers 40 ground parallel with a thickness of 0.010 inch.

After assembly of the blow box 21, it is machined on its inner bore (the walls of cavity 18) to have a uniform snug sliding fit with plunger 22. This machining may extend through sleeve 50 and both of the charge or magazine tubes 24A and 24B. A snug fit between sleeve 50 and plunger 22, together with starting the air supply only when the plunger 22 has reached sleeve 50, safeguards against possible blowing of sand between the tube 24A or B at this position and the pad 49, if their sliding fit is not air-tight.

Although vent screens 81 have been shown in enlarged mouths of vents 17 formed in the cope 12, it is somewhat more common for the vent screens to be similarly provided in vents in the blow plate, as in FIGS. 7 and 8, with the mold cavity opening to them.

Ports 58 in plunger 22 should be similarly protected by vent screens, so that sand will not be blown backwards through these ports during venting through muffler 54.

The more basic features of this invention could be used with only one magazine tube, and only one blow plate. Much greater production can be achieved as illustrated. Also, the blow plate in the idle position can be hand-cleaned after each blow, if found necessary.

The blow plates 11 do not need to be especially designed for each core box. Vent ports in the blow plate that lie outside of the contact with the cope, or that are not aligned with cope vents, can just be unused, with no detriment.

It is expected that each batch of sand in rapid mixer 27 will scour off any residue left by the previous batch. Although the original binder on the individual particles may have set, these particles will be scattered through the new batch so as not to be a serious adulterant and probably pick up some fresh binder from them. If found necessary, vertically extending wiper blades 78 may be carried by mixing blades 28, to wipe the inner wall of rapid mixer 27.

Charging tubes 24A and 24B may be provided with conical base rings 79 to provide larger slide surfaces engaging pad 49, and to scrape this pad clean.

Apparatus for measuring out, by volume or by weight, is readily available, and therefore need not be disclosed here in detail.

The material at present preferred for blow tube 16 is Buna-N rubber. Of course, the blow tube can be omitted when not needed for a particular mold.

It is important that the slots in the form of the invention of FIGS. 1 to 4 be smaller than the smaller sand particles. The sand commonly used in foundries, passing 50 mesh and retained on 60 mesh, is larger than the 0.01 inch slits.

Some possible uses of the inventive concept may not always be the best uses. For example, the ports 58 could be omitted from plunger 22. This may be best on some machines, but in the form of FIGS. 1 to 4, results without them have been inferior. The plunger 22, if passed snugly through a seal ring sealing blow box cavity 19, could have slight clearance from the wall of cavity 19, or possibly even substantial clearance, at least if it is found that the air flow in this confined clearance prevents progressive build-up of sand or binder accretions.

It is expected that any structure (i.e. "means") moving in the cavity 19 for displacing the fluidized sand toward the mold, preferably substantially all of the sand, would be beneficial as compared with practice before this invention. The sleeve 50 could in theory be omitted, as by machining the opening through the deck 47 to fit the plunger 22 snugly. Or that fit could be loose, and the fit with top wall 48*a* of blow box 21 (or a seal thereon) could be snug. Some designers may consider it desirable to secure the blow box 21 to the deck 47 with slight self-accomodation, to be able to slide laterally in any direction minutely to accomodate itself to the position of plunger 22. The oscillating rotor 34, 36, 76 can be regarded as just one of a variety of means available for shifting parts from a blow position to an alternate position, or intershifting twin parts. In fact, at the time of this continuation-in-part application, the preferred form of the invention shown in FIGS. 5 to 12 uses neither the oscillating motor nor pairs of parts.

In case a form of the invention using brushes 39 is to be chosen, their positioning as shown in FIG. 2 was preferred when they were used. In FIG. 1 they are shown as if swung from this position, but this is for the sake of showing one in FIG. 1.

MEANING OF "SAND" IN THIS APPLICATION

Although this invention is most important in the foundry field, other uses are expected to prove important also. This applies to the bottom-blow invention below, as well as to the foregoing. It is possible that in some of its many uses, the material will not be a sand in the chemical sense. The word "sand" should therefore be taken as including anything of sand-like character, i.e. that can be blown by the blow boxes of this application into a mold or the like. In some uses, the "sand" might be, for example, manufactured, such as beads; or vegetative, such as grain particles.

THE CONTROL SYSTEM—EARLY FORM

In FIG. 1, a control system has been indicated, but only diagrammatically. Such systems are so thoroughly within the common skill of the art that there is no need to encumber this application by the details of an example. It may help the designer, however, to set forth a schedule of actuations that is believed to be suitable, assuming a 24 pound core is being blown and that the freshly mixed sand has a 15 second curing time. Each item begins with a number in the margin that represents the number of seconds from the start of the cycle.

0. Start the control unit, either by automatic operation of a stripping unit that has completed removing the piece molded, or by button pressing. The latter would preferably require pressing two buttons so located that the operator is safe.

0.5 Start elevating clamp table 14 and drag 13 from its lowermost position where drag 13 was stripped to the position in which it closes against the cope resting on stops 71. Allow 2½ sec.

2. Dump the premeasured amounts of the two non-curing sand mixes into the fast mixer. Unless mixer motor runs constantly, start it, perhaps after ½ sec.

4.5 Open gate 26 to dump mix into charger tube 24A or B.

5. Energize swing cylinder 33 to swing the oscillating rotor through 180° (clockwise one time, counter-clockwise the next). 1.75 seconds is allowed for the swinging movement.

6.75 Finish the elevating of clamp table 14, pressing cope 12 against the blow plate 11, and this against the blow box 21. Also, at about this time the gate 26 is closed, and the motor of the rapid mixer 27 may be stopped.

7.5 Start the plunger 22 downwardly by fluid to top of cylinder 83.

8.5 (Or by signal when the plunger 22 enters the sleeve 50) actuate solenoid valve 53 to supply pressured air. The air will go both to shell 45 of blow box 21 and to the inside of plunger 22. Also (or any time after the 180° swing is completed) start cleaning plunger 37 through the idle blow tube.

9.5 Deenergize the solenoid valve 53 to exhaust the blowing air from the blow box 21 and plunger 22 through muffler 54. If an adjustable time delay device for curing time is provided, as is preferred, actuate it.

19.5 or when the time delay expires, or at set earlier time, lower clamp table 14 at least slightly, or until clamp ring 69 rests on stops 71. An initial movement before curing strength has developed helps lip 66 break off any plug within tube 16.

20. or at end of full cure time, lower clamp table 14 slowly for "slow draw" separation of drag 13 from cope 12, using restricted hydraulic flow in line controlling the cylinder 68.

20.5 Lower clamp table 14 the rest of the way by unrestricted flow. Also raise plunger 22 from the blow box 21 to its top position. Stripping may start as soon as the drag is all of the way down. In fact, the final movement of the drag can cause stripper pins to separate the molded piece from the drag. During the stripping period, if not before, the measuring or filling of measuring dispensers 32B and C should be started. If gates are provided for discharge of the non-curing mixes to the measuring device, these gates may now be opened.

ACHIEVEMENT

From the foregoing it is seen that the problem of using fast setting sand mixes in the blowing of cores and other foundry pieces has been solved. Even with ordinary mixes, wastage can be reduced, and more uniform packing of molds can be achieved.

THE INVENTION IMPROVED WITH BOTTOM-BLOW

Since the filling of the parent application, the invention has been greatly improved in several respects. Perhaps the most important improvement is a new form of blow box. In addition, there is an improved rapid mixer, and some simplification of the manipulative parts of the machine. These are all shown diagrammatically in the figures new in this application, FIGS. 5 to 12.

A simplified manipulation indicated in FIG. 5 is the use of a single magazine tube 84 that is merely reciprocated by air cylinder 86 between its full-line position where it has dumped into blow box 87, and its broken-line position where a fresh sand mix would be dumped into it. The magazine tube 84 carries at its top a gate plate 88 which extends across the bottom end of mixer bowl 89 to close it except when transfer tube 84 is positioned below it to receive from it the freshly mixed quick-set sand mix.

When magazine tube 84 is positioned as shown in FIG. 5 in full lines, it is aligned with and between plunger 91 and blow box 87. As it reaches this position, the pressured air supply to cylinder 92 is actuated to drive the plunger 91 down through transfer or magazine tube 84 and blow box 87 wiping them both clean, and filling the space in blow box 87 so that all of the fluidized sand is forced into the mold, although a slight residue might be retained in blow plate 94. Although blow plate 94 and mold 93 are different from those shown in the earlier figures this is not significant, as these may vary for every product made. Any blow plate forms a bottom of sand cavity 95.

Although blow box 87 could be as in FIGS. 1 to 4, an important improvement added by the present application is a greatly improved blow box that enhances the features of the plunger invention, and is also of great value even if no plunger is used.

BOTTOM-BLOW BLOW BOX

The new blow box is seen best in FIG. 7. Instead of a finely apertured wall, cavity 95 has a smooth-walled imperforate tube 96 extending from the top of the blow box almost to the top of blow plate 94. This leaves a bottom-blow gap 97 between the tube, or cavity wall 96 and the top plate 98 of the blow plate 94. An air-supply chamber 101 surrounds the slot or gap 97, and with proper timing is supplied with pressured air through fitting 102, by means not shown in this Figure. This blowing may start when the plunger moves into the top of tube 96 to seal it, as seen in FIG. 7. When plunger 91 has moved through its stroke, its lower end will be even with the bottom of tube 96. Now the entire air stream entering slot 97 will have no place to go except out through the exit 103, which is the passage through the blow plate 94 into the mold 93. It will therefore blow the last residue of sand out of the blow box.

Surprisingly, there is no need for the slot 97 to be fine enough to retain the sand, as with the apertured wall of FIGS. 1 to 4. The top plate 98 forms the bottom of gap 97 and leaves the sand no place to go, so that it only spreads out into or through the gap 97 the limited amount permitted by the sand's angle of repose. This permits the gap 97 to have a gap width sufficient to let the air flow freely, i.e. with only a desired production of back pressure. This permits, in turn, a reduced air supply pressure for economy. There is also economy in needing less compressed air because the air is always blown into the bottom where it is most effective in moving the sand to and through the exit 103. A gap width of 1/16 inch has been found to give a good balance of freedom of flow and good air speed.

There is great manufacturing economy in using the simple tube 96 instead of the stack of plates of FIG. 1, with spacers, tie rods and expensive machine work. If the tube 96 needs any machine work for a proper sliding and clean-wiping fit with plunger 91, it will be minor.

As seen in FIG. 6, where purging is taking place, the bottom blow and plunger are valuable in that operation. Here a purge pan 107 has been moved from its receded position of FIG. 5 to its purging position sealed against blow plate 94. Its movement to this position may include an upward component, as by raising, or a 10° slant of, tracks 105. With the plunger down, as seen in FIG. 6, the purging air is confined to blowing directly to exit 103, and being unopposed by the air resistance of a filled mold, has maximum cleaning effectiveness on top plate 98 and the bottom of plunger 91. For these surfaces, a very short blast of purging air is sufficient, accomplishing virtually perfect cleaning.

As illustrated in FIG. 8, the bottom-blow blow box can also be advantageous without the plunger, as in blowing conventional sand, not quick setting. Here it is assumed that conventional sand mix (sand and conventional non-quick binder) has been supplied to cavity 95, and the cavity's top then sealed by a seal plate 99 and seal ring 100. After movement of either of these to provide approximately the disposition shown, the final sealing may be by upward thrust of the blow box 87 by the mold 93, the seal plate at this time being fixed. Although the blowing air swirls through the entire cavity 95 during the entire blow, it nevertheless has a tendency to push the bottom sand in cavity 95 directly to and through exit 103.

Although the perfect cleaning of FIG. 6. may not be achieved without the plunger, it is not needed for conventional sand. A small residue of sand remaining, but falling to the bottom of cavity 95 before new sand is added is harmless when it is not quick-setting. The blowing only through the bottom peripheral slot, with the air velocity toward the exit 103 tends to sweep that bottom residue of older sand directly to exit 103, with minimal mixing thereof with the fresh sand. Throughout the blow, the bottom blow is more effective in moving the sand through the exit 103, than the same amount of air blown through perforate cavity walls.

It is very important to sweep almost all residual sand out through exit 103, so that only a trace or negligible amount of it will still be in the cavity at the end of the blow to be residual sand a second time. And there will be only a "trace-of-a-trace" the third time so that each blow fills its mold with sand substantially free from sand as stale as remaining from the second previous blow.

The purge pan 107 drains into a purge or discard bin 108, and is shuttled between its two positions by air cylinder 109. In its receiving position, it is biased upwardly to seal against the blow plate 94, in any manner conventional for sealing parts thus moved. A flexible hose 111 accomodates its movement. Of course, it is moved to its receiving position after cylinder 112 lowers clamp table 113, and mold 93, as indicated in FIG. 6.

IMPROVED RAPID MIXER

The rapid mixer 89 shown in FIG. 5 is improved according to one aspect of the present invention, and it is shown in detail in FIGS. 9 to 12.

The utmost rapidity of mixing that is attainable is desired. One reason is that the more thorough the mixing, the better the sand piece product. As explained earlier, the two sand mixes supplied to the rapid mixer when quick setting sand is desired may be non-curing but are quick-curing when mixed. With completely thorough mixing, every particle of each pre-mix would be activated for quick setting by contact with the other pre-mix. Then every particle of binder would contribute its maximum share to the strength of the product. Another reason rapidity of mixing is desirable is for the ideal timing of the overall operation, or process. As soon as the mixing starts, the curing begins, but only in the particles that have been exposed to the mutual activation of contact with each other. If mixing takes one second longer than it has to, that will be one-second-less available for the remainder of the process. Another aspect is that if the chemistry must allow for an extra second of mixing, as well as for whatever time is required for the remainder of the operation, then the utmost quick-setting advantage cannot be achieved.

As seen in FIG. 5, the rotor 116 of rapid mixer 89 is driven by motor 117, the drive preferably being constant. The details of the form of rotor 116 now preferred are seen in FIGS. 9 to 12. But first it may be seen in FIG. 5 that the rotor shaft 118 is carried by drive shaft 119 in a manner to be confined to rotation about the axis, extended, of drive shaft 119. As diagrammaticly indicated by air bag 121, drive shaft 119 and the rotor shaft 118 it carries may be raised or allowed to settle downwardly. If desired, the rotor rests on gate plate 88. If preferred, the downward movement can be limited to maintain a minute clearance between the rotor and gate plate 88. Thus, carrier 122, which slides on slide rods 120, could, without letting rotor 116 touch plate 88, come to rest when air bag 121 is vented, on a stop 125, which could be adjustable. Carrier 122 carries motor 117 and also bearing blocks 123, the latter determining the height of drive shaft 119, and rotor 116, carried in chuck 124 on shaft 119.

FIGS. 9 to 12 show a form of the rotor 116 that has been found to mix the two sand-mix components very quickly and thoroughly. The shaft 118 has fixed thereon two impingement paddles 126 and a bottom scraper 127. Each paddle 126 is secured to the shaft 118 by a hub collar 128. As seen best in FIG. 10, the two paddles 126 lie on opposite sides of shaft 118. This is also indicated by the full lines in FIG. 12. The broken lines in that figure represent a phantom position of the upper paddle 126 provided for the purpose of showing the mutually staggered relationship of the two paddles vertically. Not only is upper paddle 126 higher than lower paddle 126 at both top and bottom, but also each peripheral gap 131 of each paddle 126 is at the same height as a peripheral lug 132 of the other paddle 126.

The rotor 116 is rotated constantly, in the direction that yields a downward thrust for both of the paddles 126 on the sand that they encounter. After one batch of freshly mixed quick-set sand is dumped into magazine 84, and that magazine has been shuttled away to bring the gate plate 88 into position to form a closed bottom for mixer bowl 89, a control system similar to that of FIG. 1 times the actuation of feeders 106 to feed the right amount of each sand, timed for mixing. Arms 129 may make initial contact, as impellers. There is probably no need to be certain what the exact action is, but apparently the good results that have been established result from successive impingements by lugs 132, with successive portions of the sand in the vicinity struck being by-passed as if passing through the gaps 131, to then be impacted with (and therefore well mixed with) a different zonal body of sand, when struck by the lug 132 of the other paddle 126.

The downward thrust of the paddles 126 aids gravity in quickly discharging all of the sand, when the metered feeding has stopped, into the magazine 84. Any that falls on the gate plate 88 is swept by scraper 127 into position to fall into magazine 84. Preferably rotor 116 is quickly raised and lowered just before the magazine 84 is moved away, and after the feed of sand has ceased, so that the tip of scraper 127 cleans the lower part of bowl 89. The raising of the paddles 126 at the same time tends to dislodge any sand that may have spattered upwardly when struck by the upper end portions of paddles 126.

Figure 10:
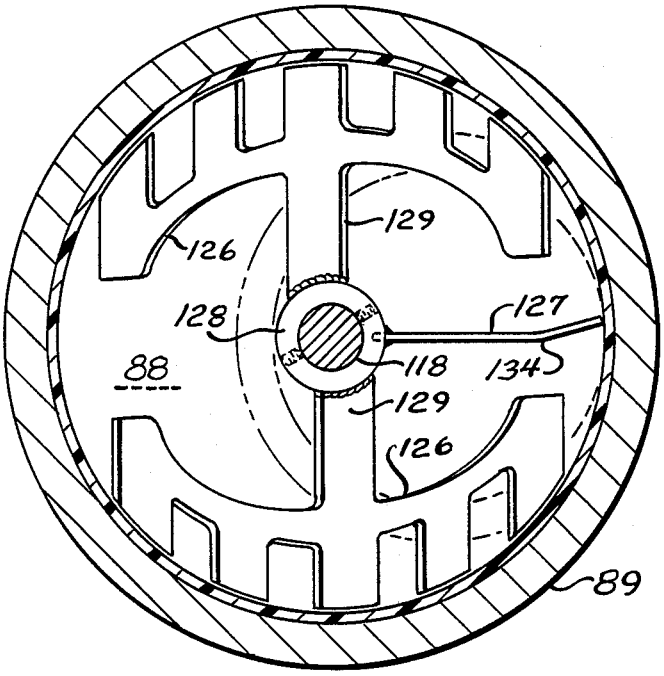
Figure 11:
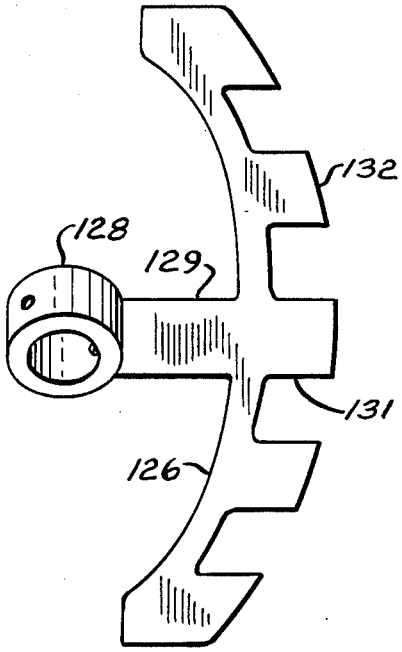

As seen in FIG. 10, the scraper 127 preferably has a bend 134 near its free end, and it is formed of a malleable material, so that as it wears, it may be straightened slightly to preserve its proper cleaning reaction with bowl 89.

FURTHER DETAILS AND MODIFICATIONS

It is not essential that the air movement in the bottom-blow gap or slot 97 be horizontal. There could, for example, be some beveling that would make the air move inwardly and downwardly. It is much preferred that this gap be continuous, especially for quick-set sand, so that no sand will be in the lee of an obstruction and not be blown out. Nevertheless, some of the advantages of the bottom-blow concept would be attained with a peripheral series of separate openings. With one slot, or separate openings, the discharge cross-section should be small enough to cause moderate back pressure to ensure peripheral uniformity of discharge.

The indications in FIGS. 5 to 12 of control by a Control System ("CS") do not mean the same control system as in FIGS. 1 to 4. As for those figures, however, experts will have no trouble in designing the needed control system. Some preferred sequences have already been indicated. A schedule of actuations may again be helpful, some brevity being possible by relying in part on the schedule above.

0. Clamp table 113 starts "up" movement, its mold clamps also being actuated, perhaps with manual valve. Mixer motor 117 runs continuously. Feeders 106 start feeding the two sand premixes to mixer bowl 89 near its center, running time depending on size of core, e.g. 2½ seconds for 6 lb. core.
2.5 magazine tube 84 moves back, less than 1 second, to receive.
4.2 to 5. Magazine tube 84, now charged, moves to blow position.
5. According to present preference for raising the rotor 116, the supply of air to air bag 121 starts when movement of magazine tube 84 and its associated gate plate 88 have closed the bottom of mixer bowl 89. One second, and one second venting.
5. Plunger starts down, by actuation of cylinder 92. (2 seconds.)
5.6 (approx). Blow starts, i.e. supply of pressured air to fitting 102. This may be started by time control or by a position-actuated switch, when the plunger seals tube 96. About 1¼ sec.
7.2 Table 113 starts down, about 1 sec. Purge pan 107 may start moving to purge position as soon as its path is cleared. If mold 93 and table 113 are to be shuttled to another position for stripping (removing the molded sand piece) this may start when mold 93 is sufficiently lowered.
9.3 Purging starts. If the plunger 91 was advanced to or almost to the plate 98, as preferred, it starts upwardly at once. It should not be retracted higher than the top of slot 97 until all sand has been cleared from the blow box by at least the first blast of purging air. The purge continues slightly over 1 sec. to blow all sand into the purge bin 108.
10.7 Retention of purge pan may start as soon as purge blow stops.
11. Suitable time to remove core box from table 113. With intershuttling of two tables 113, each with core box, the alternate table 113 could start up when purge pan 107 is out of its path, at least as soon as 11.5 seconds.

There is reason to believe that the rotor 116 should rotate in the range of 400 to 600 RPM, approximately, the rotor being 8 inches in diameter. Mixing is inferior with a speed of 1000 RPM. Good mixing even when the gate plate 88 opens within a second after the two feeders 106 stop feeding tends to indicate that while the two streams to be mixed continue, there is substantially-instant full mixing continuously and progressively.

I claim:

1. A mold-blowing apparatus comprising a blow box for blowing sand from the blow box into a mold, said blow box having a sand-receiving cavity leading to a blowing exit at one end, and being apertured for admission of fluidizing air essentially only at that end, for the admission of air to the cavity to fluidize the sand in the cavity and blow it through the exit, and displacement means movable within the cavity for excluding fluidized sand from the space it occupies to cause more complete removal of the sand from the cavity through the exit.

2. A mold-blowing aparatus comprising a blow box for blowing sand from the blow box into a mold; said blow box having a sand-receiving cavity with a blowing exit at its bottom; the blow box being apertured for admission of fluidizing air to the cavity essentially only at its bottom, peripherally of the cavity to cause fluidizing air as it enters the cavity to move toward the exit to move bottom sand in the cavity through the exit while fluidizing other sand in the cavity to be blown toward and through the exit.

3. A mold-blowing apparatus as claimed in claim 2 wherein the blow box is so constructed as to retain any sand spreading from the cavity before fluidizing air is admitted, to lie within the path of the air moving toward the exit to be blown into the cavity or through the exit as the blowing starts.

4. A mold-blowing apparatus as claimed in claim 2 further comprising a displacement means moving within the cavity for excluding fluidized sand from the space it occupies to cause more complete removal of the sand from the cavity through the exit.

5. A mold-blowing, apparatus as claimed in claim 2, further comprising a rapid mixer, two feeders for feeding streams of sand mixes into the mixer, and means for quickly dumpinng sand from the mixer into the blow box cavity.

6. A mold-blowing apparatus comprising a blow box for blowing sand from the blow box into a mold, said blow box having a sand-receiving cavity with a blowing exit at its bottom; the blow box being apertured for admission of fluidizing air to the cavity essentially only at the bottom of the cavity, with a continuous peripheral gap surrounding and opening into the cavity to admit fluidizing air moving toward the exit to move bottom sand in the cavity through the exit while fluidizing the other sand in the cavity to be blown through the exit after the bottom sand.

7. A mold-blowing apparatus comprising a blow box for blowing sand from the blow box into a mold, said blow box having a downwardly extending substantially imperforate tube forming a cavity for receiving sand, and a blow plate forming the bottom of the box and spaced below the tube to form a continuous gap therebelow opening into the cavity, and having a blowing exit for the cavity and surrounded by said gap; said box forming an air supply passage surrounding the gap to blow fluidizing air through the gap and cavity toward the exit to blow bottom sand in the cavity directly through the exit, and to fluidize other sand in the cavity and blow it also through the exit.

8. A mold-blowing apparatus as claimed in claim 7 wherein the blow box is so constructed as to retain, within the path of air moving toward the exit, any sand spreading from the cavity before fluidized air is admitted so that the spread sand will be blown into the cavity or through the exit.

9. A mold-blowing apparatus as claimed in claim 7 further comprising a displacement means moving within the cavity for excluding fluidized sand from the space it occupies to cause more complete removal of the sand from the cavity through the exit.

10. A mold-blowing apparatus as claimed in claim 2 further comprising a plunger snugly fitting the tube and moving within it toward the exit to cause more complete removal of the sand from the cavity through the exit.

11. A mold-blowing apparatus as claimed in claim 7 further comprising a plunger snugly fitting the tube moving through it substantially to the bottom of the tube to cause substantially complete removal of the sand from the cavity through the exit by the fluidizing air.

12. A mold-blowing apparatus as claimed in claim 11, further comprising a rapid mixer, means for feeding into the rapid mixer two sand mixes neither of quick-set character, and means for quickly dumping mixed sands from the mixer into the blow box cavity.

13. A mold-blowing apparatus as claimed in claim 11, further comprising a rapid mixer, means for feeding into the rapid mixer two sand mixes, neither of quick-setting character, means for quickly dumping the mixed sand mixes from the mixer into the blow box cavity, a purge receiver relatively movable to receive sand from the exit after sand is blown into the mold, and an air supply means including means for blowing air through the gap while the plunger is substantially at the bottom of the tube and the purge receiver is in position to receive sand from the exit as the air scours the blow plate and plunger bottom.

14. A mold-blowing apparatus as claimed in claim 13, wherein the rapid mixer includes vertical axis impeller means tending to spread the sand along a surrounding wall, and peripherally notched rotating blades slanting in a direction tending to drive the sand downwardly.

15. A mold-blowing apparatus as claimed in claim 7, further comprising a rapid mixer, two feeders for feeding streams of sand mixes into the mixer, and means for quickly dumping mixed sand from the mixer into the blow box cavity.

16. A mold-blowing apparatus as claimed in claim 7, further comprising a rapid mixer, two feeders for feeding different sand mixes into the mixer, means for quickly dumping mixed sand from the mixer into the blow box cavity, a purge receiver movable to receive sand from the exit after sand is blown into the mold, and on air supply means including means for blowing air through the gap while the purge receiver is in position to receive sand from the exit.

17. A mold-blowing apparatus for blowing sand into molds including a blow box means forming a sand receiving cavity and an exit at the bottom of the cavity and centrally located therein, a plunger movable into the cavity and through it approximately to the bottom of the cavity, and including an air supply means for fluidizing the sand and blowing it through the exit, said air supply means combining with said blow box to define an air path unobstructed by the movement of the plunger and being so constructed as to blow air, when the plunger is near the bottom, into cavity peripherally thereof to scour surfaces leading to the exit for blowing sand clinging thereto through the exit.

18. A mold-blowing apparatus as claimed in claim 17 including also a purge receiver movable to replace the mold at the exit to receive sand from the exit; the air supply means being designed to blow a purging blast similarly after the purge receiver has replaced the mold.

19. A mold-blowing apparatus as claimed in claim 18, including also a rapid mixer, two feeders for feeding to it different sand pre-mixes, and means for quickly dumping mixed sand from the mixer into the cavity.

* * * * *

UNITED STATES PATENT AND TRADEMARK OFFICE

CERTIFICATE OF CORRECTION

PATENT NO. : 4,570,694

DATED : Feb. 18, 1986

INVENTOR(S) : Robert S. Lund

It is certified that error appears in the above-identified patent and that said Letters Patent is hereby corrected as shown below:

In column 3, line 34, for "to" read --by--, and in line 50 omit "end".

For "moving" read --movable-- in claims 4 and 9, 2nd line of each; and in claims 10 and 11, 3rd line of each In claim 10, line 1, for "claim 2" read --claim 7--.

In claim 16, line 52 of the column, for "on" read --an--.

In claim 17, line 66 of thé column, after "into" read an inserted --the--.

Signed and Sealed this

Twelfth Day of April, 1988

*Attest:*

DONALD J. QUIGG

*Attesting Officer*

*Commissioner of Patents and Trademarks*